US007712492B2

(12) United States Patent
Hu

(10) Patent No.: US 7,712,492 B2
(45) Date of Patent: May 11, 2010

(54) PLANING BLADE AXLE

(76) Inventor: Teng-Fu Hu, 6F., No. 146-21, Sec. 1, Dongshan Rd., Beitun District, Taichung City (TW)

( * ) Notice: Subject to any disclaimer, the term of this patent is extended or adjusted under 35 U.S.C. 154(b) by 402 days.

(21) Appl. No.: 11/744,436

(22) Filed: May 4, 2007

(65) Prior Publication Data

US 2008/0271326 A1 Nov. 6, 2008

(51) Int. Cl.
*B27C 1/00* (2006.01)

(52) U.S. Cl. ..... 144/117.1; 144/220; 144/221; 407/48; 407/103

(58) Field of Classification Search ..... 144/117.1, 144/218, 220, 221, 228, 230; 407/48, 58, 407/59, 103
See application file for complete search history.

(56) References Cited

U.S. PATENT DOCUMENTS 4,074,737 A * 2/1978 Stewart ..... 144/117.1
4,564,321 A * 1/1986 Kondo et al. ..... 407/36
5,083,887 A * 1/1992 Dotany ..... 407/59
5,211,212 A * 5/1993 Carlson et al. ..... 144/241
5,603,365 A * 2/1997 Stewart ..... 144/230
5,944,456 A * 8/1999 Shirley et al. ..... 407/42
6,116,305 A * 9/2000 Lin ..... 144/221
7,163,360 B2 * 1/2007 Toyose ..... 407/36

* cited by examiner

*Primary Examiner*—Shelley Self
(74) *Attorney, Agent, or Firm*—Egbert Law Offices PLLC

(57) ABSTRACT

The planing blade axle includes an axle body and blades assembled externally onto the axle body in a predefined pattern. Tapped holes are arranged onto the blade assembly surface of the axle body for assembly of blades. A pyramidal through-hole is placed centrally onto the blade, so that the blades screw securely into the tapped hole via the bolts with pyramidal end blade. An expanded shoulder is additionally placed at a top of the pyramidal through-hole, so that an expanded flange is placed opposite to the pyramidal end of the bolt. When the blade is screwed by the bolt, a definite and solid positioning effect will be achieved if the flange contacts the expanded shoulder of the blade. The present invention efficiently prevents excessive locking and subsequent cracking of the blade, increasing positioning area, leading to prolonged service life and a more stable locking state with improved applicability.

4 Claims, 9 Drawing Sheets

PLANING BLADE AXLE

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a blade, and more particularly to an improved planing blade having a planing blade axle with combined blades.

2. Description of Related Art Including Information Disclosed Under 37 CFR 1.97 and 37 CFR 1.98

A planing blade axle structure generally comprises an axle body and some blades assembled externally onto the axle body in a predefined pattern. Currently, a lot of combined blade patterns are available. The typical structures are shown in FIGS. 1, 2 and 3, wherein the blades 20 of axle body 10 are provided with pyramidal through-holes 21, and tapped holes 12 are arranged onto the blade assembly surface 11 of the axle body 10 for assembly of blades 20. Moreover, the blades 20 are screwed securely onto the axle body 10 via bolts 30 with the pyramidal end 31.

However, the typical structure is found to have the following shortcomings during application. First, the blades 20 are screwed onto the axle body 10 through the oblique compression between the pyramidal end 31 of bolt 30 and pyramidal through-hole 21 of the blade 20, as shown by the hollow arrow in FIG. 3. The extremely large application of force will possibly lead to cracking the blades 20 due to the lack of a positioning point at the oblique surface and the smaller gap between the pyramidal through-hole 21 and the surrounding surface. Thus, a possible slight crack may have an adverse impact on the operation of axle body 10, shortening the service life of the blades 20 in the cutting activities.

On the other hand, the other shortcoming of a typical axle body 10 is shown in FIG. 1 is that concave portions 13 are arranged tangentially onto the blade assembly surface 11 with tapped holes 12. These concave portions 13 make the axle body 10 generate turbulence during high-speed rotation, so the wood scraps in the planing process will shift radially towards the axle body 10 along the concave portions 13, thus affecting the next planing process, leading to defective workpieces or poorer processing quality.

Thus, to overcome the aforementioned problems of the prior art, it would be an advancement in the art to provide an improved structure that can significantly improve efficacy.

To this end, the inventor has provided the present invention of practicability after deliberate design and evaluation based on years of experience in the production, development and design of related products.

BRIEF SUMMARY OF THE INVENTION

There is enhanced efficacy of the present invention. Referring to FIG. 6, an expanded shoulder 53 is additionally placed at top of pyramidal through-hole 52 of the combined blade 50 of the planing blade axle, so that an expanded flange 62 is placed opposite to the pyramidal end 61 of the bolt 60. When the blade 50 is to be screwed by the bolt 60, a definite and solid positioning effect will be achieved if the flange 62 contacts the expanded shoulder 53. No tight compression will occur between pyramidal end 61 and pyramidal through-hole 52, since a gap 80 will be formed between pyramidal end 61 of the bolt 60 and pyramidal through-hole 52 of the blade 50. As compared with the prior art, the present invention efficiently prevents the excessive compression and subsequent crack of blades. On the other hand, the contact between the flange 62 and expanded shoulder 53 will increase the positioning area of blade 50, leading to prolonged service life and a more stable locking state with improved applicability.

Referring also to FIG. 9, based upon another technical feature of the present invention, some blocking flanges 44 are shaped at one side of the recessed portion 43 between blade assembly surfaces 41 of the axle body 40. The blocking flange 44 prevents the wood scraps from entering into the next planing process or spraying onto the finished workpieces, thus resolving another shortcoming of the prior art with improved planning quality and applicability.

There are improvements brought about by this invention.

Referring to FIGS. 7, 8, the expandable metal gasket 70 is assembled between the expanded shoulder 53 at top of pyramidal through-hole 52 of the blade 50 and the flange 62 of pyramidal end 61 of the bolt 60. Thus, it shall be possible to avoid loosening of bolt 60; and it shall also be possible to improve the structural strength of combined blades 50, if the circumference 71 of the gasket 70 could be flexibly filled into the gap between the flange 62 and the side wall 54 of expanded shoulder 53 when the flange 62 of the bolt is compressed downwards.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

The features and the advantages of the present invention will be more readily understood upon a thoughtful deliberation of the following detailed description of a preferred embodiment of the present invention with reference to the accompanying drawings.

Figure 1:
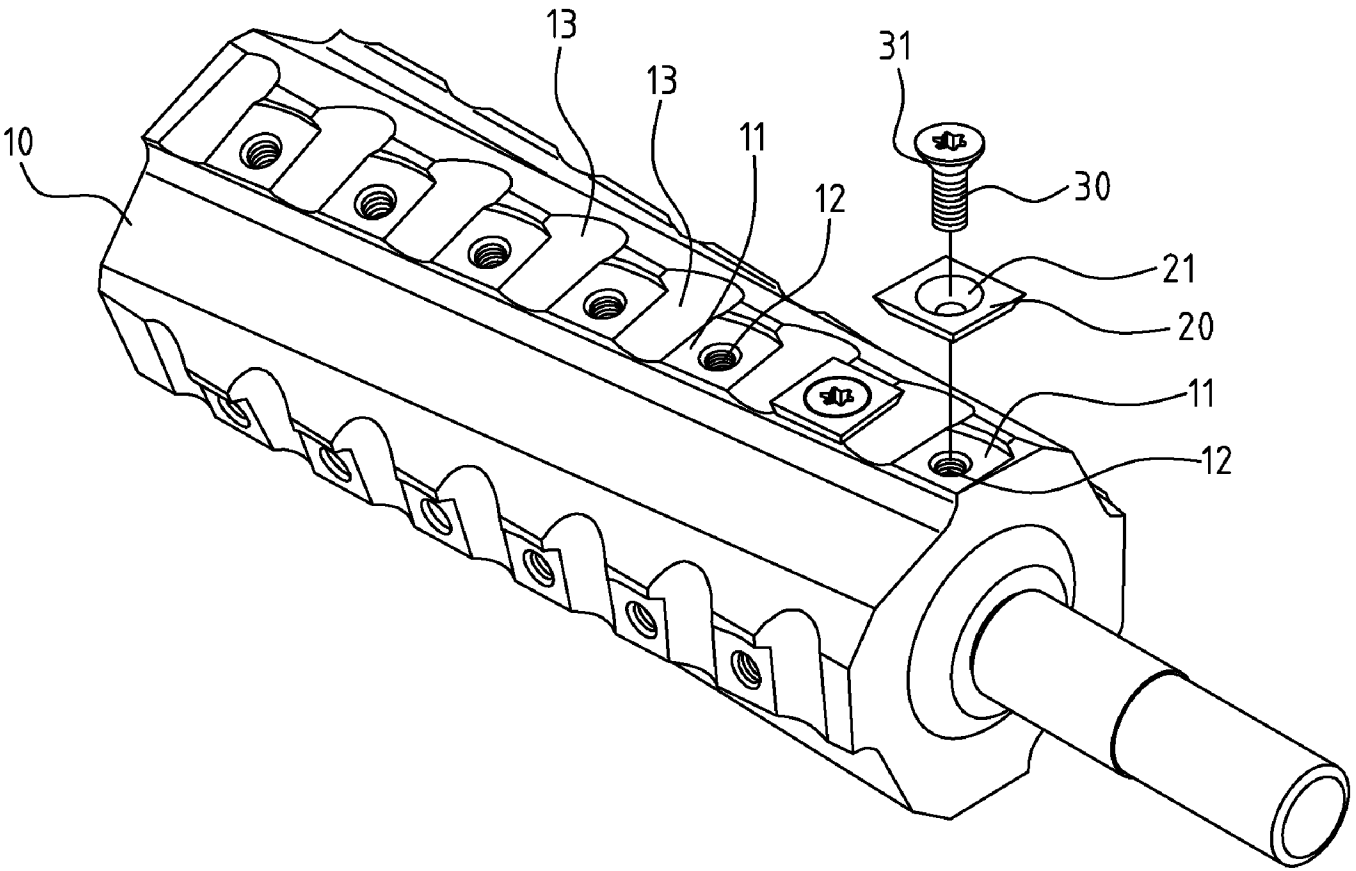
FIG.1 PRIOR ART
FIG. 1 shows a perspective view of a typical prior art structure of a planing blade.
Figure 2:
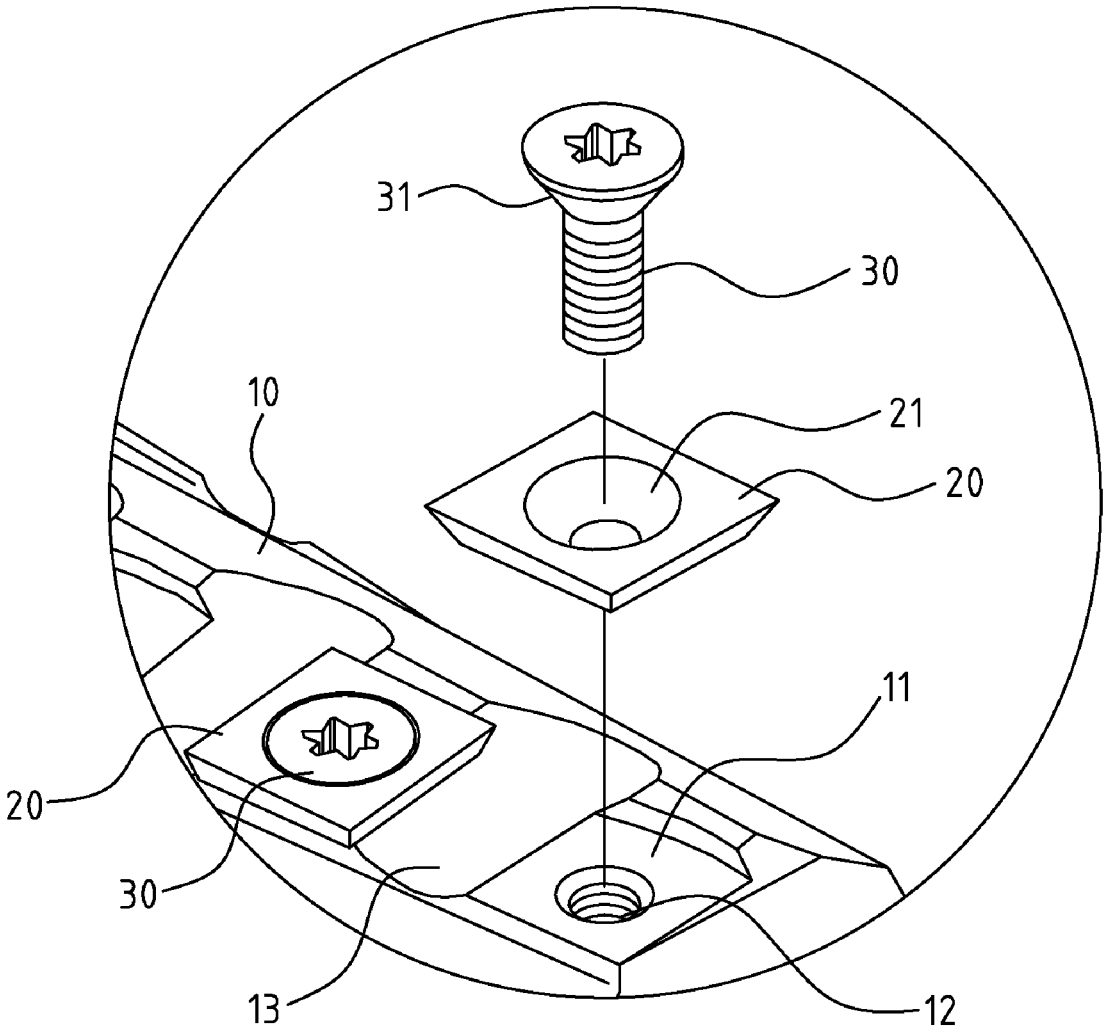
FIG.2 PRIOR ART
FIG. 2 shows a partially enlarged perspective view of the structure of FIG. 1.
Figure 3:
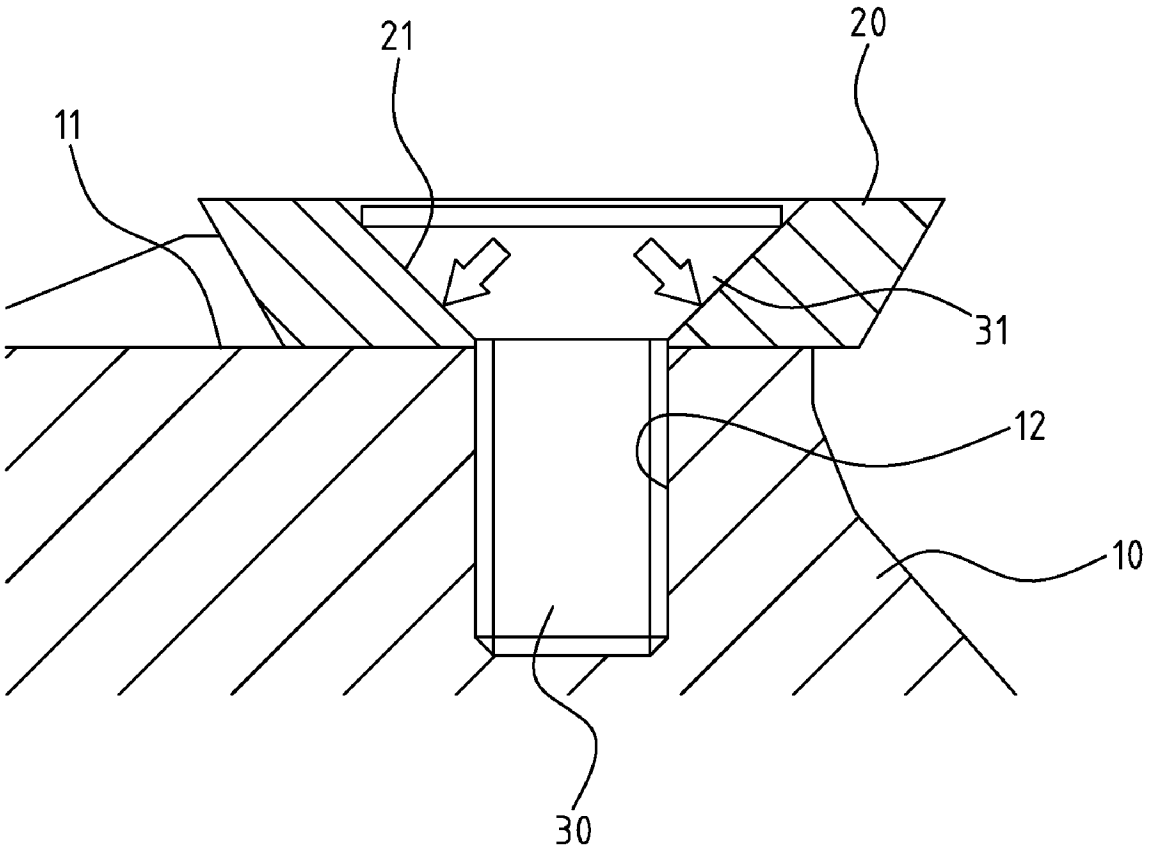
FIG.3 PRIOR ART
FIG. 3 shows a partially assembled sectional view of a typical prior art structure.
Figure 4:
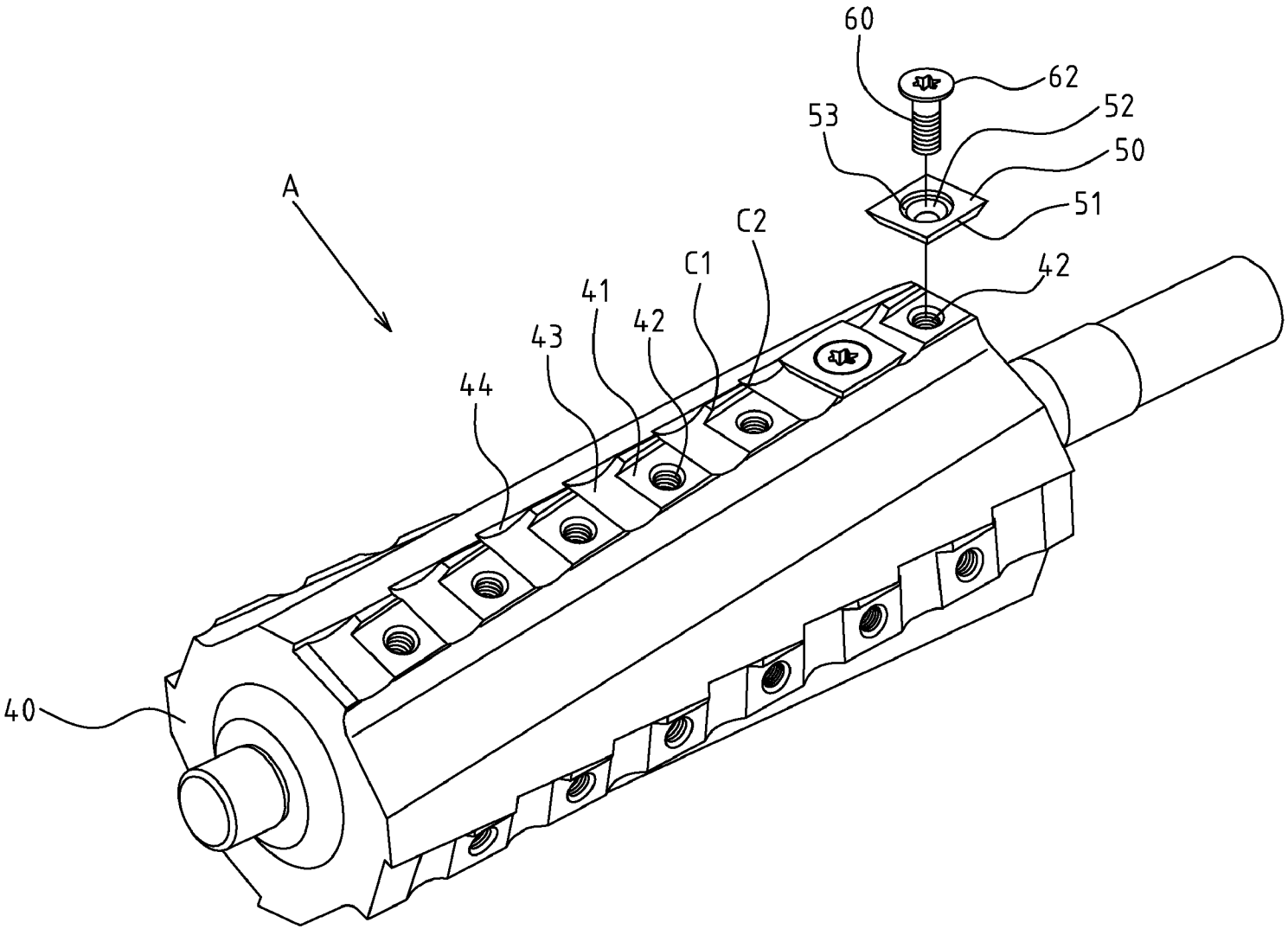
FIG. 4 shows a perspective view of the present invention.
Figure 5:
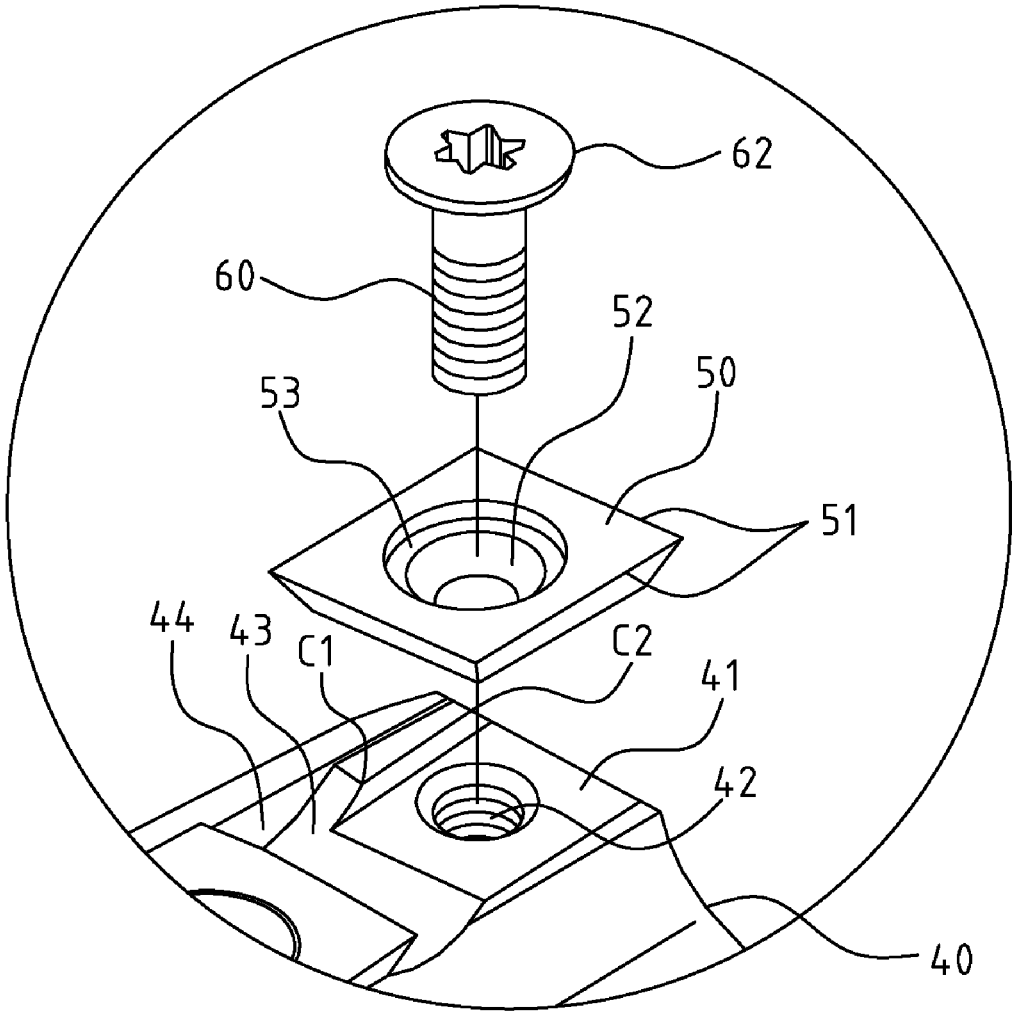
FIG. 5 shows a partially enlarged perspective view of the present invention in FIG. 4.
Figure 6:
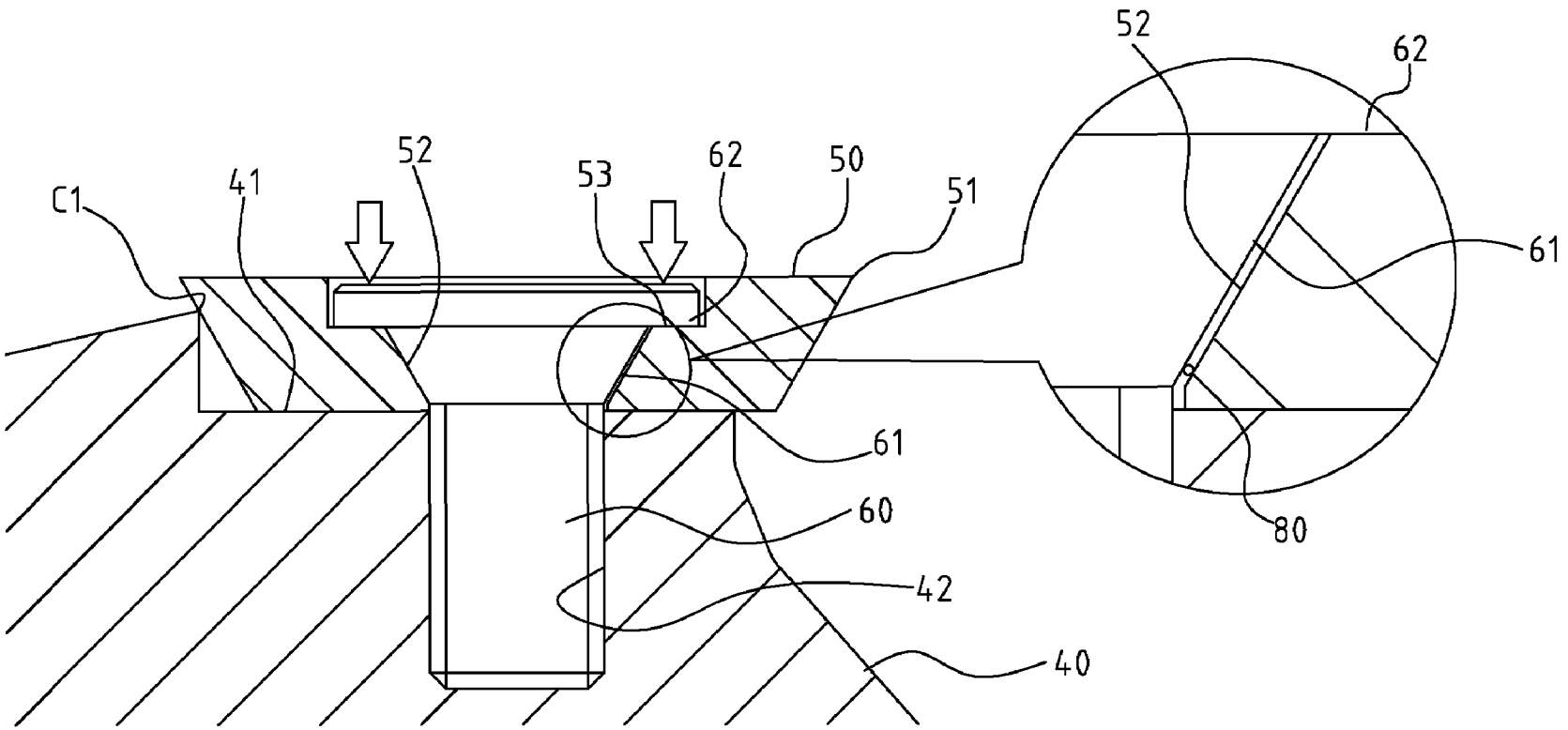
FIG. 6 shows a partially assembled sectional view of the present invention.

FIGS. 4, 5 and 6 depict preferred embodiments of the improved structure of the planing blade axle of the present invention. The embodiments are provided only for explanatory objectives.

Figure 9:
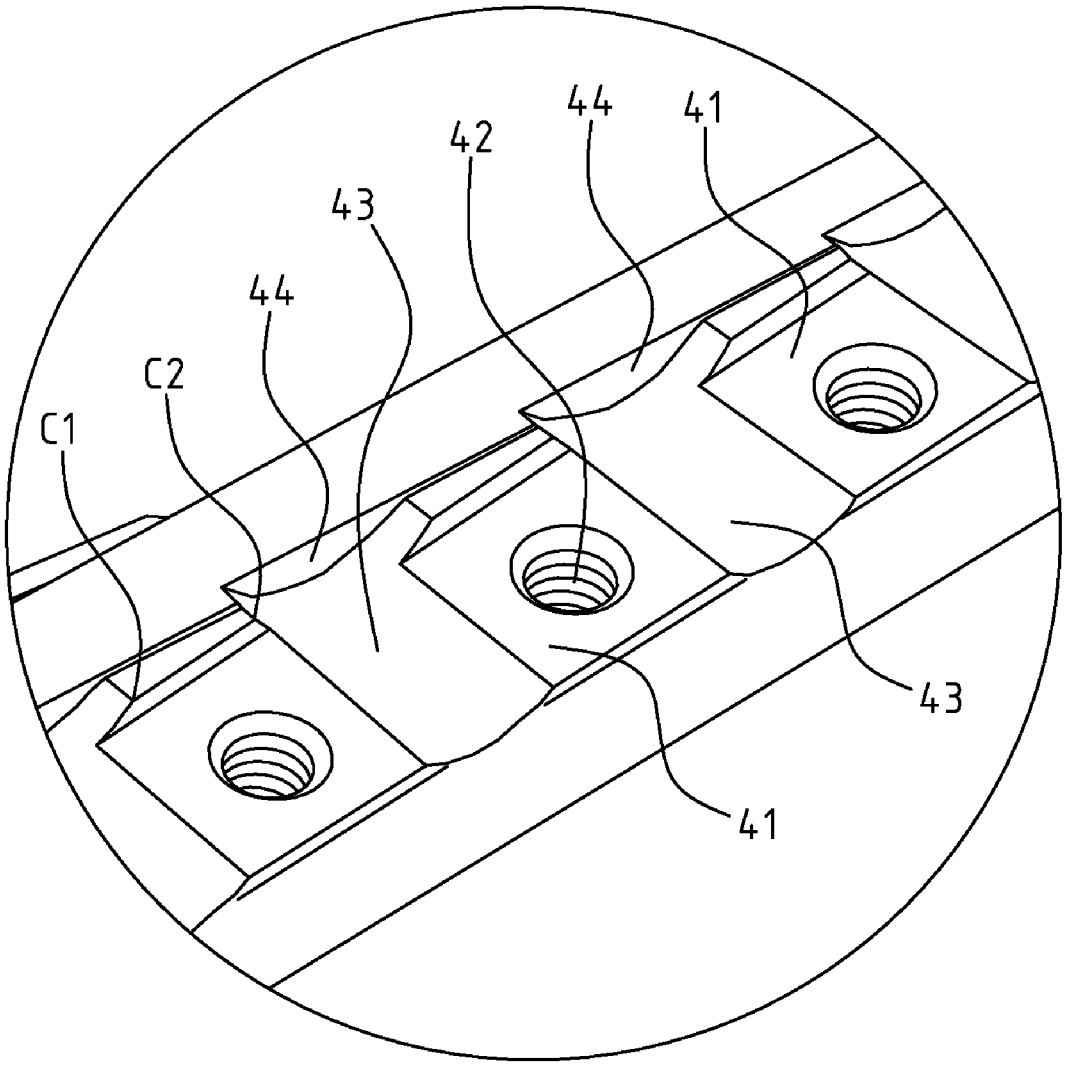
FIG. 9 shows a partially enlarged perspective view of the concave portion of the present invention, one end of which is fitted with a blocking flange.

The planing blade axle A comprises an axle body 40, and some blades 50 are assembled externally onto the axle body 40 with a predefined pattern. Tapped holes 42 are arranged onto the blade assembly surface 41 of the axle body 40 for assembly of blades 50. The blades 50 are fitted with cutting edges 51, specifically four cutting edges for a blade of the preferred embodiment. A pyramidal through-hole 52 is placed centrally onto the blade 50, so that the blades 50 could be screwed securely into the tapped hole 42 of blade assembly surface 41 via the bolts 60 with pyramidal end 61. Moreover, recessed portions 43 (e.g. hollow cabochon with convex top and flat bottom, shown in FIG. 9) are formed between the blade assembly surfaces 41. At one side of various blade assembly surfaces 41, compressing points C1, C2 are provided to generate orientation of assembled blades 50 (referring to FIGS. 5, 6) to avoid the rotation of blades 50.

There are improvements of the present invention.

An expanded shoulder 53 is additionally placed at a top of the pyramidal through-hole 52 of the blade 50, so that an expanded flange 62 is placed opposite to the pyramidal end 61 of the bolt 60.

Based upon above-specified structures, as shown in FIG. 6, when the blade 50 is positioned by the bolt 60, the blade 50 will be forced to shift rightwards to generate a gap 80 between pyramidal end 61 and pyramidal through-hole 52 through their oblique guidance as well as the compression of compressional point C1 of the blade assembly surface 41. So, no tight compression will occur between pyramidal end 61 of the bolt 60 and pyramidal through-hole 52 of the blade 50. When the blade 50 is to be further screwed by the bolt 60, a definite and solid positioning effect will be achieved if the flange 62 contacts the expanded shoulder 53 at atop of pyramidal through-hole 52 of the blade 50 (namely, the bolt is screwed tightly), meanwhile the flange 62 and the blade 50 are compressed and positioned more stably.

The expanded shoulder 53 of the pyramidal through-hole 52 of the blade 50 and the flange 62 of pyramidal end 61 of the bolt 60 can be configured in a ring pattern.

Some blocking flanges 44 are shaped at one side of the recessed portion 43 between blade assembly surfaces 41 of the axle body 40.

Figure 7:
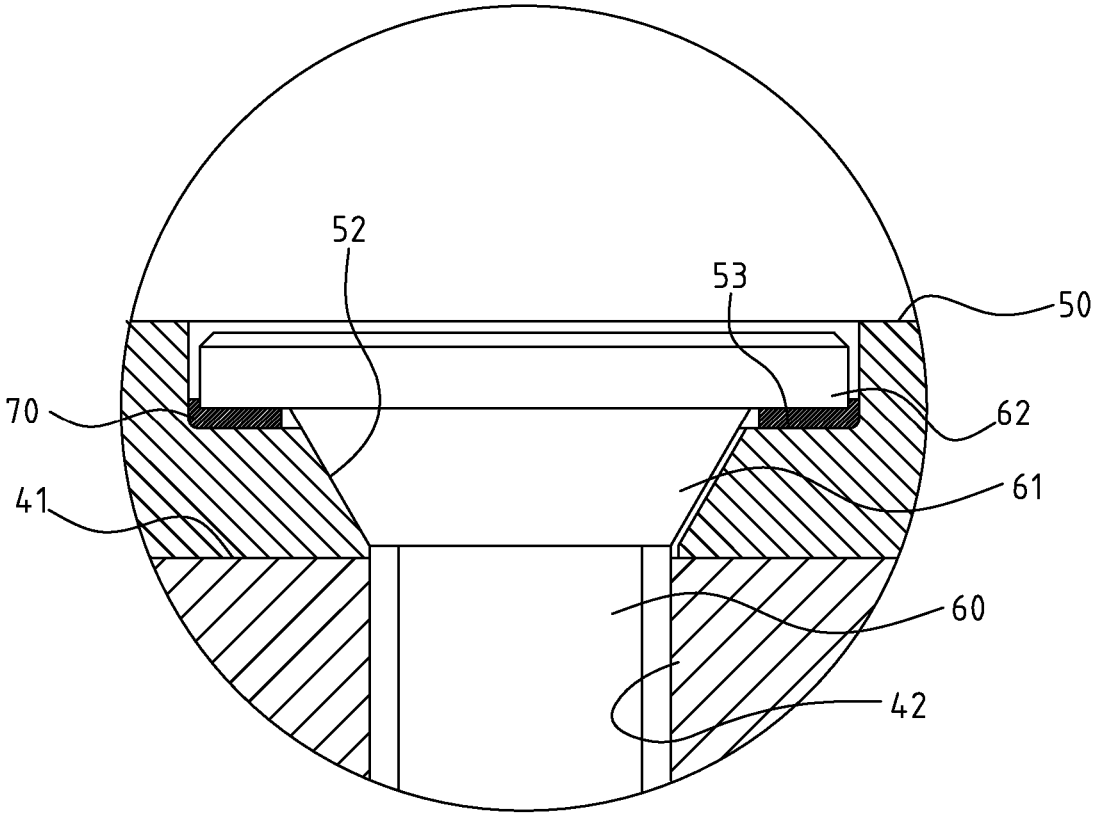
FIG. 7 shows a perspective view of the application of another structural pattern of the present invention.
Figure 8:
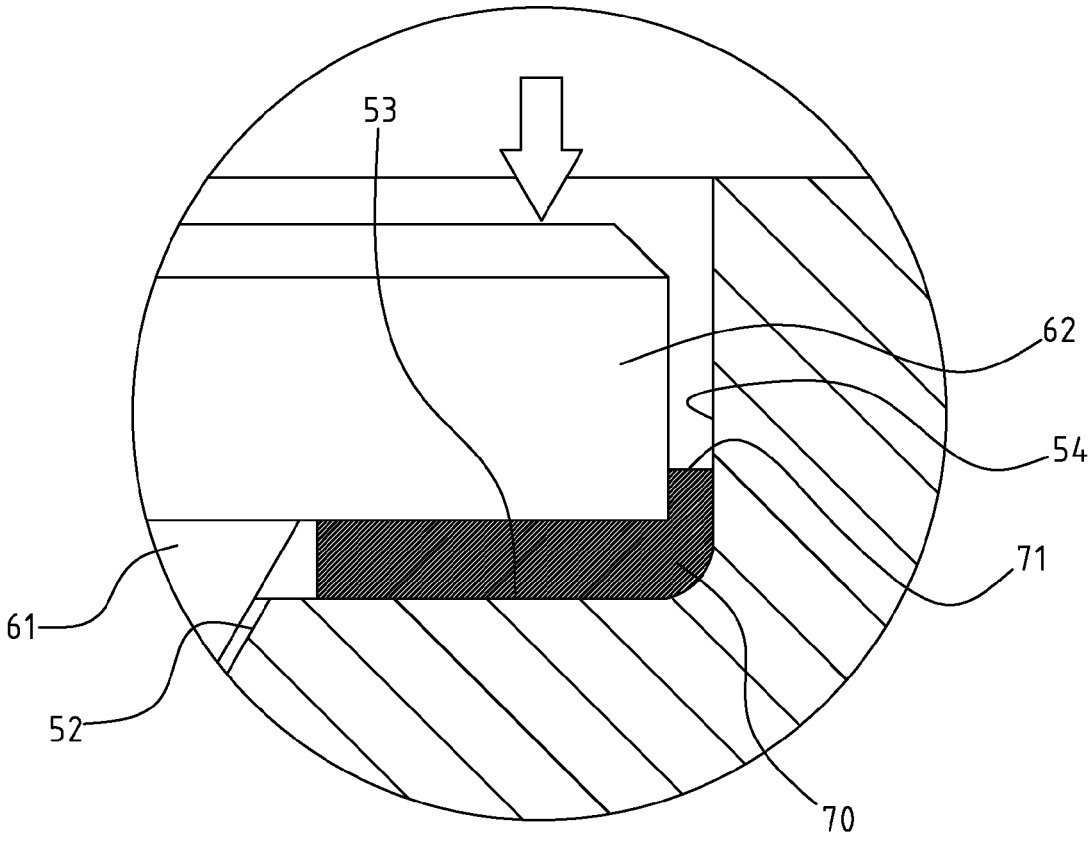
FIG. 8 shows a partially enlarged perspective view of FIG. 7.

Referring to FIG. 7, an expandable metal gasket 70 may be assembled between the expanded shoulder 53 at a top of the pyramidal through-hole 52 of the blade 50 and the flange 62 of pyramidal end 61 of the bolt 60. One purpose for assembly of the gasket 70 is to prevent any possible loosening of the bolt 60. The second purpose is to reinforce the structure and improve the structural strength of blades 50, if the circumference 71 of the gasket 70 (shown in FIG. 8) could be flexibly filled into the gap between the flange 62 and the side wall 54 of expanded shoulder 53 when the flange 62 of the bolt is compressed downwards.

Additionally, the planing blade axle of the present invention is designed in a manner that the axle body 40 is fully combined with the blade 50. The combined blades 50 allow the blades 50 to separate from the axle body 40, and the blades 50 and the axle body 40 are not required to be procured from the same manufacturer. So, the blades 50 can be independently purchased. For this reason, it is stated hereto that, a combined blade 50 structure of planing blade axle with expanded shoulder 53 can be assembled at the top of pyramidal through-hole 52, and also can be operated independently from the axle body 40.

I claim:

1. A planing blade axle comprising:

an axle body having blade assembly surfaces thereon, each of said blade assembly surfaces having a plurality of through-holes formed therein, each of said plurality of through-holes having a tapped hole extending into said axle body the tapped hole being threaded;

a plurality of blades assembled externally onto said axle body in a predefined pattern, each of said plurality of blades having cutting edges at a periphery thereof, each of said plurality of blades having a tapered hole formed centrally therein such that a narrow diameter of said tapered hole is at a bottom of the blade and a wide diameter of said tapered hole is away from said bottom of the blade, the blade having an opening at a top thereof, said opening extending to a shoulder formed at said wide diameter of said tapered hole, said shoulder extending radially away from said tapered hole; and a plurality of bolts each a threaded shank and a tapered portion extending from an end of said threaded shank and a flange extending outwardly of said tapered portion opposite said shank, said threaded shank received by the tapped hole. Said plurality of bolts respectively extending through the opening and the tapered holes of said plurality of blades such that said flange is juxtaposed against said shoulder so as to fix the blade onto said blade assembly surfaces, said blade assembly surface having a recessed portion formed between adjacent blade assembly surfaces.

2. The planing blade axle of claim 1, said shoulder and said flange having a circular shape.

3. The planing blade axle of claim 1, said recessed portion having a blocking flange at one side thereon.

4. The planing blade axle of claim 1, further comprising:

a metal gasket positioned between said shoulder and said flange.

* * * * *